US005131353A

United States Patent [19]

Bauer et al.

[11] Patent Number: 5,131,353

[45] Date of Patent: Jul. 21, 1992

[54] CRANK LOOP FRAME FOR A CRANK LOOP DRIVE OF AN INTERNAL COMBUSTION ENGINE

[75] Inventors: Alois Bauer, Sankt Solfgang; Wolfram Hellmich, Munich; Manfred Schindler, Markt Schwaben, all of Fed. Rep. of Germany

[73] Assignee: Ficht, GmbH, Kirchseeon, Fed. Rep. of Germany

[21] Appl. No.: 619,060

[22] Filed: Nov. 27, 1990

[30] Foreign Application Priority Data

Nov. 27, 1989 [DE] Fed. Rep. of Germany ... 8913971[U]

[51] Int. Cl.[5] ..... F02B 75/28

[52] U.S. Cl. ..... 123/56 AC; 123/197.4

[58] Field of Search ..... 123/197 AC, 197 R, 56 AC, 123/56 BC, 197 AB

[56] References Cited

U.S. PATENT DOCUMENTS

| | | | |
|---|---|---|---|
| 1,287,797 | 12/1918 | Tietzmann | 123/56 AC |
| 1,311,060 | 7/1919 | Felix | 123/56 AC |
| 2,101,556 | 12/1937 | Morgan | 123/56 AC |
| 4,013,048 | 3/1977 | Reitz | 123/197 R |
| 4,491,097 | 1/1985 | Hamann | 123/197 AC |
| 4,512,290 | 4/1985 | Ficht et al. | 123/56 BC |
| 4,598,672 | 7/1986 | Jayne et al. | 123/56 BC |
| 4,794,887 | 1/1989 | Valentine | 123/56 AC |

FOREIGN PATENT DOCUMENTS 5950 of 1900 United Kingdom ..... 123/56 AC

*Primary Examiner*—David A. Okonsky
*Attorney, Agent, or Firm*—Amster, Rothstein & Ebenstein

[57] ABSTRACT

In a crank loop frame for a crank loop drive of an internal combustion engine for the transformation of a back and forth motion into a rotary motion, each of the slideway frame, webs of the crank loop frame includes portions of a heat capacity sufficient for a homogeneous distribution of the heat disposed both above and below the slideway of the slideway frame web. Each of the slideway frame webs has an H-shaped cross-section and contains a longitudinal slideway web portion as well as two leg web portions disposed tangentially at the longitudinal edges of the slideway web portion. The areal center of gravity of each slideway frame web is disposed to the side of its respective slideway remote from the slide, thereby to promote dissipation or the homogeneous distribution of heat to both sides of the slideways.

27 Claims, 7 Drawing Sheets

CRANK LOOP FRAME FOR A CRANK LOOP DRIVE OF AN INTERNAL COMBUSTION ENGINE

The invention relates to a crank loop frame for a crank loop drive of an internal combustion engine for the transformation of a back and forth motion into a rotary motion.

An internal combustion engine of the type described in DE-OS 34 33 510, for instance, has at least two piston/cylinder units mutually opposite on one axis, their rigidly attached piston rods being coupled by a crank loop drive disposed between the piston/ cylinder units. The crank loop drive, by means of which the back and forth motion of the piston rods is transformed into a rotary motion, usually consists of a crank loop frame to whose slideway webs the outsides of the piston rods are also rigidly attached and in whose interior sits a slide which is guided by slideways disposed on the inside of the slideway webs and in which sits rotatably a crank pin of a driven crank performing the rotary motion, the axis of the crank pin extending transverse to the axis of the piston rods.

In such internal combustion engines, as in all other internal combustion engines, there occur rapidly changing bearing loads. Such loads can lead to considerable efficiency losses and to the destruction of the crank loop drive. In internal combustion engines of this type they become noticeable, among other things, particularly also in the form of frictional heat, timewise different amounts of temperature and heat between the sliding surfaces of the slide coordinated with the crank loop frame and the slideways of the slideway webs of the crank loop frame, despite the provision of maximized bearing clearances and lubricant films. Especially alternating loads at high cycle speeds or rotary speeds lead to greater frictional heat not resulting from the calculable, increased heat which develops anyway at high cycle speeds.

In the search for possibities how to avoid this increased frictional heat, a sagging of the slideway frame webs was determined to be its cause, which sagging even led to a disruption of the lubricant film and cavitation between the slideways of the crank loop frame and the sliding surfaces of the slide, resulting in freezing and possibly destruction of the crank loop drive.

Figure 1B:
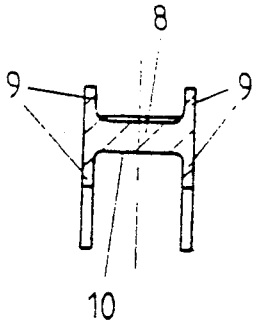

To counteract this long known problem it has been attempted to avoid the flections by reinforcing the frame design. For example, slideway frame webs of U-shape in cross-section or even double-T-shaped ones were used, such as recognizable in DE-OS 34 33 510 in FIG. 1 or in DE-OS 34 47 663 in FIG. 3. Also having become known are slideway frame webs of box shape in cross-section. Despite the use of these webs with the greatest possible resistance moments against sagging, it was not possible to solve the problem.

The object of the invention is to provide a crank loop frame which withstands the alternating stresses of the internal combustion engine so that freezing or destruction of the crank loop drive can be prevented.

This problem is solved by the features of claim 1. Advantageous further developments of the invention are characterized in the sub-claims.

The invention leaves the beaten path of solving the problem by increasing the stability of the slideway frame webs and finds the solution in surprising manner by homogeneously and quickly distributing the heat in the vicinity of the slideway frame webs. This succeeds in particular when frame webs of H shape in cross-section are used in which the areal shape gravity center lies just above the slideway so that heat absorbing webs, almost symmetrically distributed, are available for the dissipation or for the homogeneous distribution of the heat both above and below the slideways. This does not involve cooling ribs or similar heat dissipating elements, but webs of a heat capacity sufficient for a homogeneous distribution of the heat above and below the slideway frame webs. This homogeneous heat distribution sees to it that the slideway frame webs expand linearly so that the slideways remain plane and, especially, that sagging of the slidways is avoided.

It is not absolutely necessary for homogeneous heat distribution to design the slideway frame webs symmetrical in cross-section. It may be useful to design the H legs on the slide side or the H legs on the piston rod side higher and/or the legs in the piston rod area higher than in the area of the frame faces and/or to provide additional masses with additional heat capacity in the area of the faces in order to obtain a homogeneous and rapid distribution of the heat flow in these areas also.

According to a special embodiment of the invention it may be provided, in addition to the measures described, to apply to the slideway surface a poorly heat conducting coating such as of ceramic and/or a plate of poorly heat conducting material such as ceramic so that only a part of the generated heat flows into the frame. This even includes in advantageous manner the possibility of making the heat conductivity of the coating or of the plate zonally so different in the longitudinal extent of the slideways that the homogeneous heat distribution in the slide frame webs is assisted thereby. In a ceramic coating or ceramic plate, the variation in heat conductivity and/or heat capacity can be assured, for instance, by constructing the plate of layers such as ceramic foils of different heat conductivity and/or heat capacity, and/or in longitudinal direction, of platelets of different heat conductivity and/or heat capacity.

With the help of the described coating and/or plates success is even achieved in distributing and storing the heat in the coating or in the plate so that only a little heat absorption takes place, causing no distortion or sagging in the slideway frame webs so that, if desired or required, slideway frame webs of known design may be used also.

In connection with the means according to the invention to affect the heat distribution in the crank loop frame it is advantageous to design the frame, as known per se from DE-OS 34 33 510, as a split frame and to provide fastening means capable of compensating the frame part motions caused by heat to hold the frame parts together. Accordingly, it is advantageous, for instance, to use stretchable tightening straps or necked-down screws to fasten the frame parts to the crank loop frame faces and to arrange them so as to enable them to compensate for the heat related expansion of the frame perpendicular to the plane of the slideways.

Another measure according to the invention to increase the effect of the means according to the invention affecting the heat distribution in the crank loop frame provides for the prevention of the disruption of the lubricant film between the slide and the slideway surfaces as well as breakage and temperature peaks connected therewith, namely by the arrangement of recesses or socalled pittings in the slideway surfaces and/or in the slide surfaces facing the slideways, as known per se between plane sliding elements in general use for the same purpose.

The invention thus succeeds not only in guaranteeing the dimensional stability of the crank loop frame. Beyond this, the invention also permits a light-weight crank loop frame design not possible heretofore.

Figure 1A:
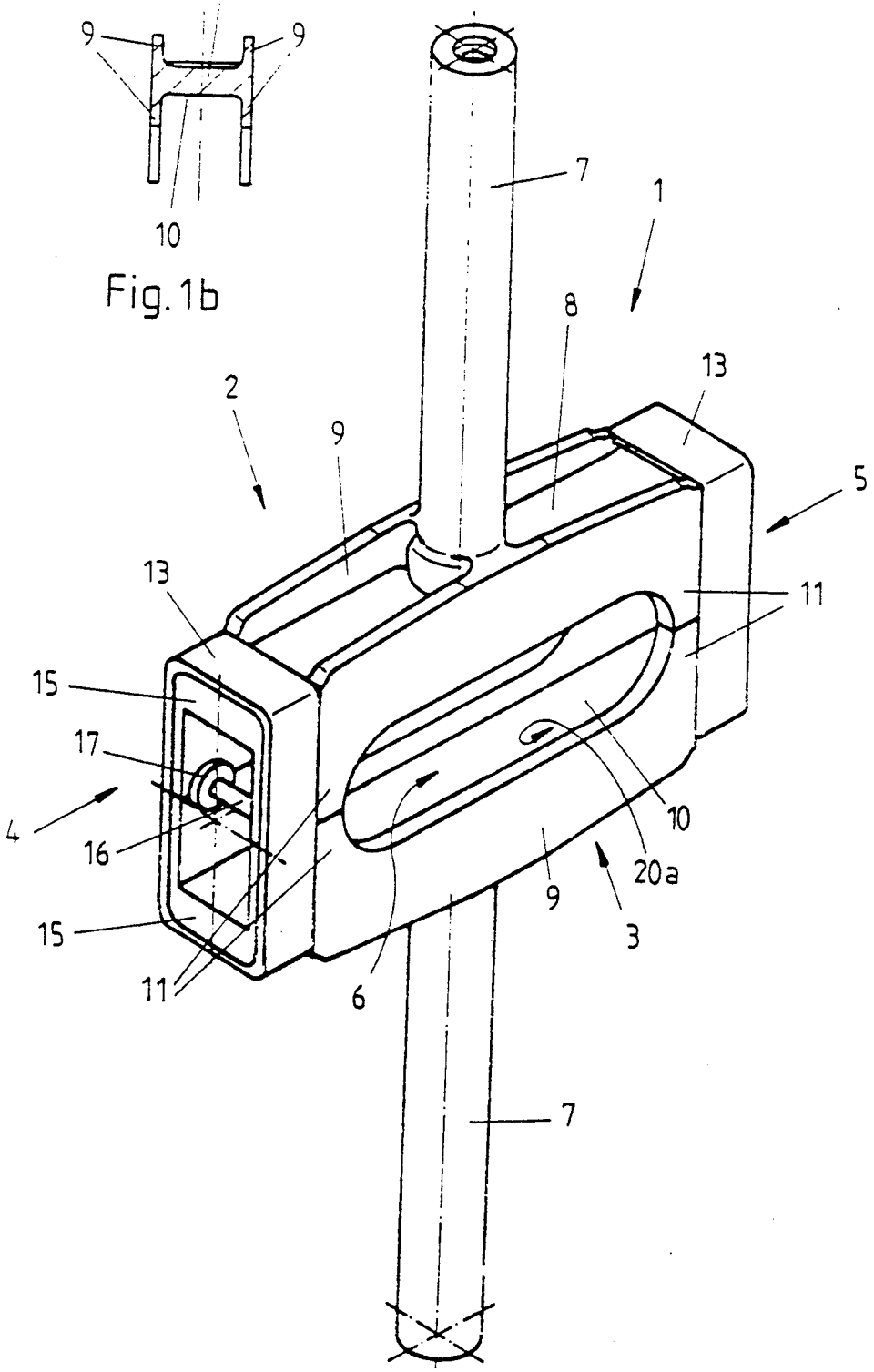
Figure 2:
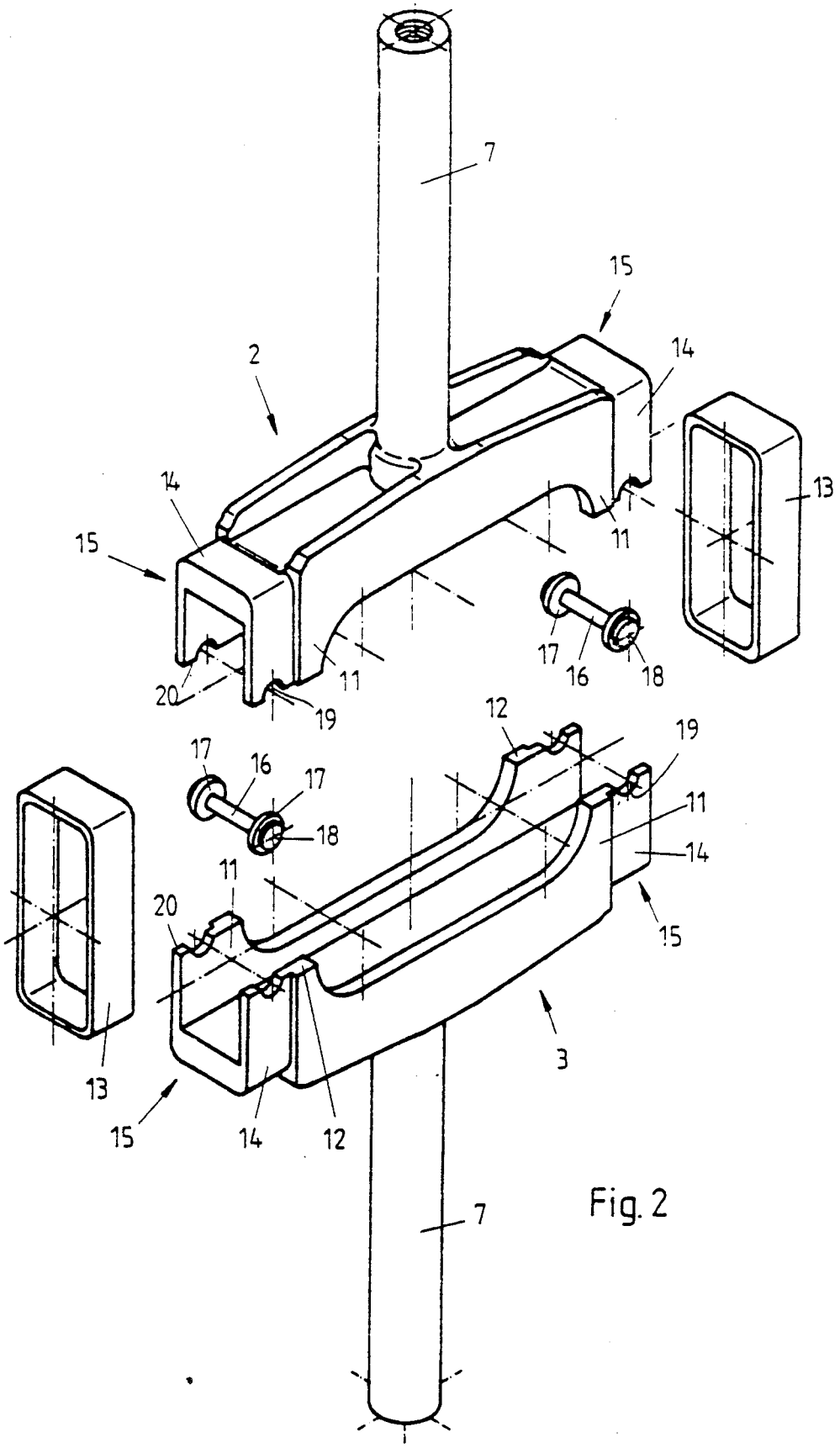
Figures 3A, 3B:
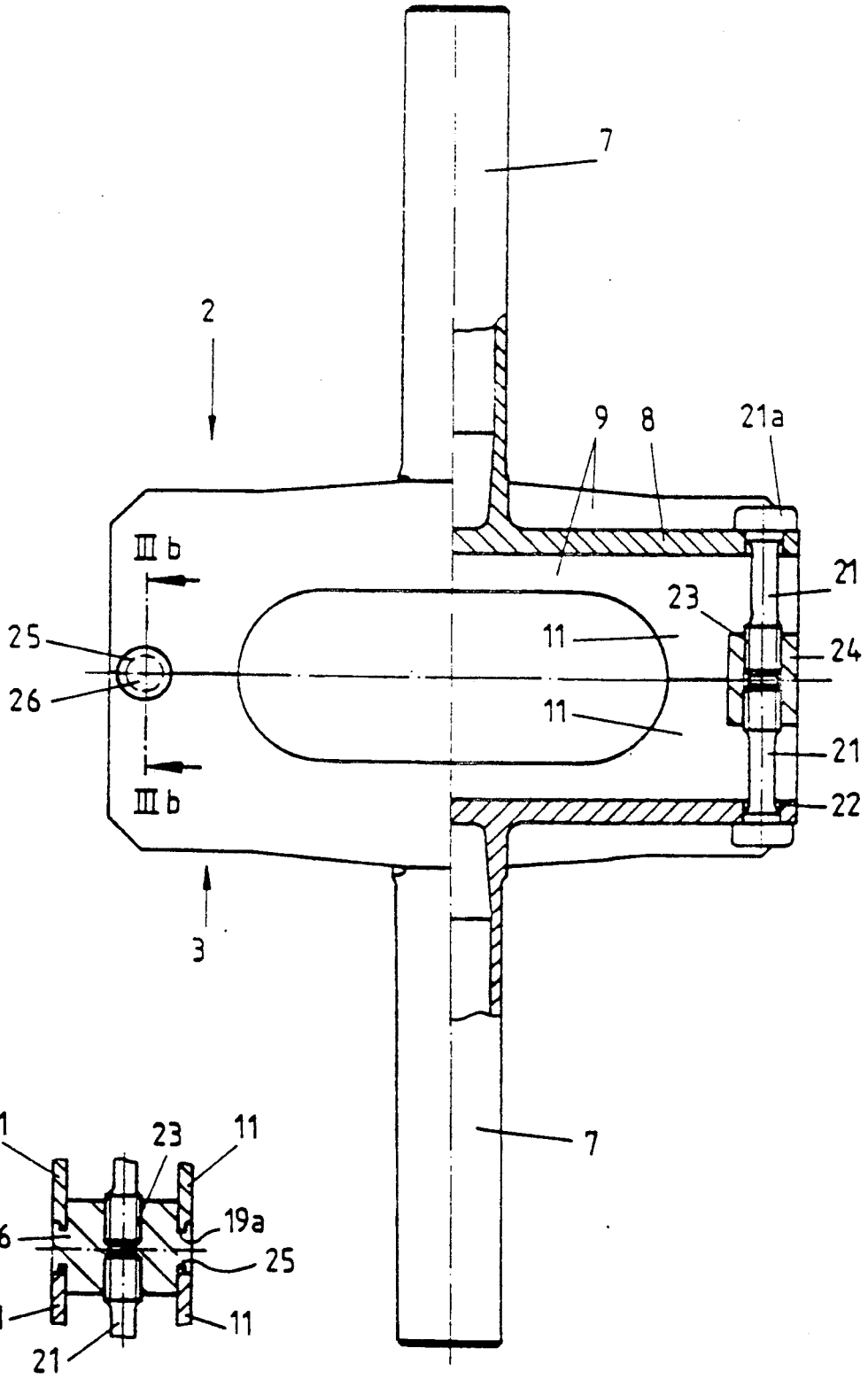
Figure 4:
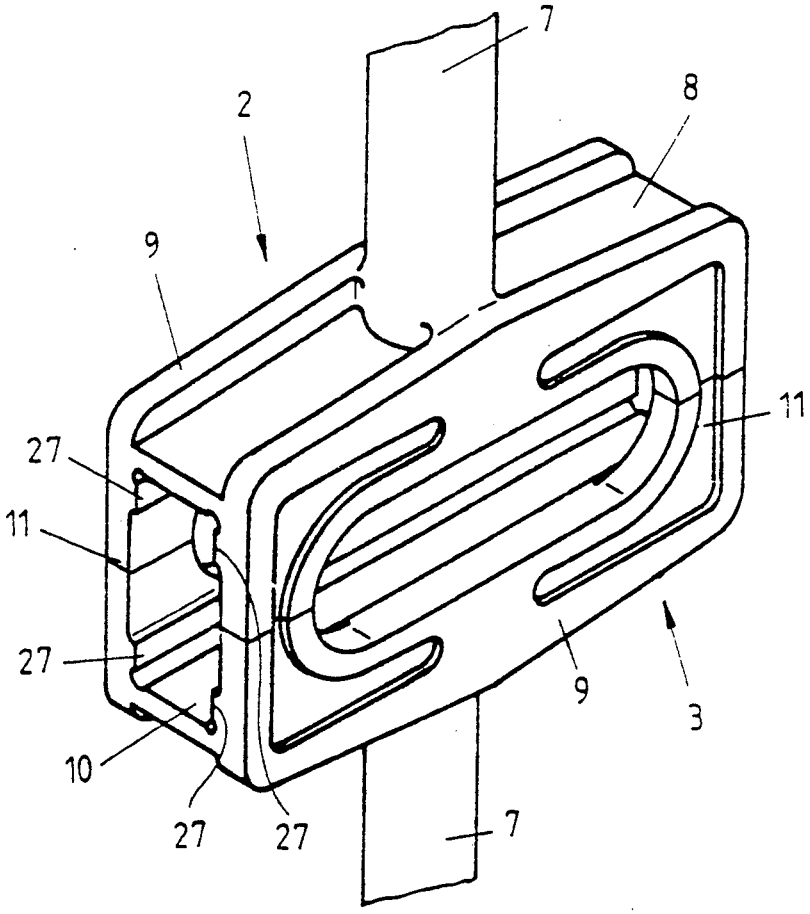
Figure 5:
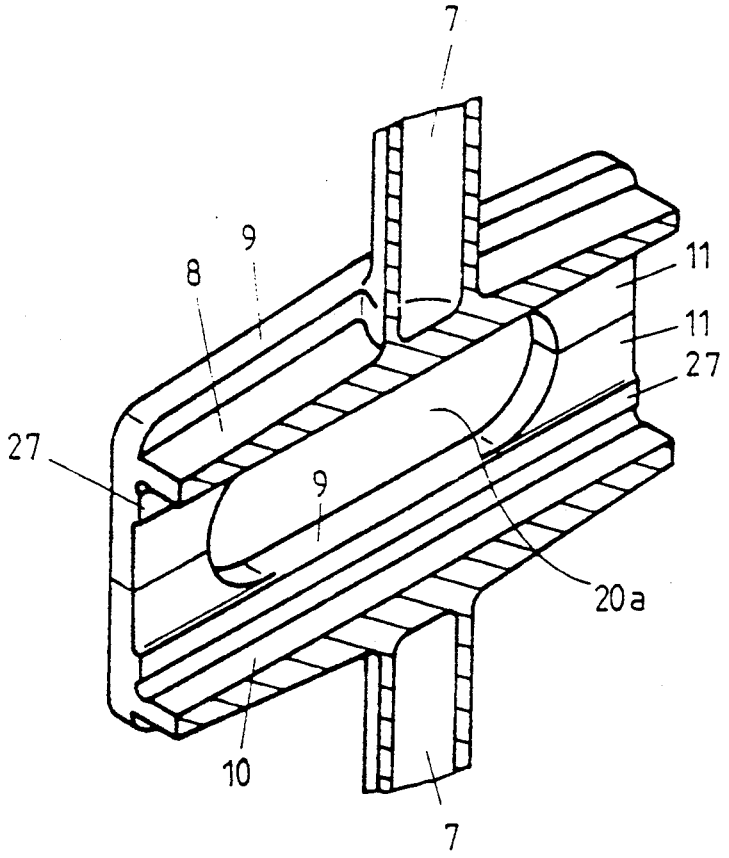
Figure 6B:
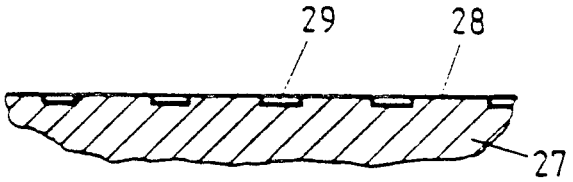
Figure 6A:
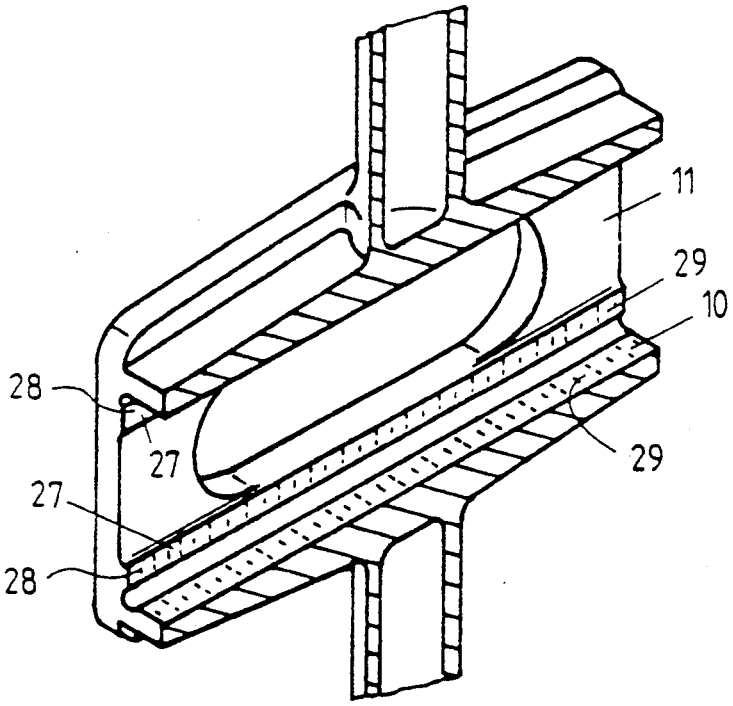
Figure 7:
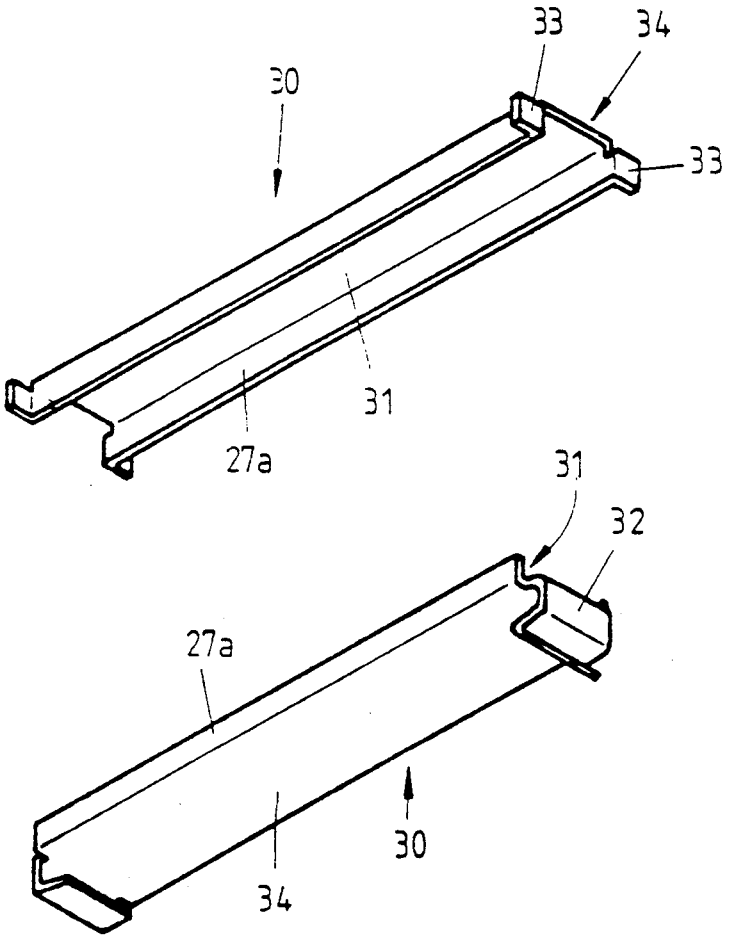

In the following, the invention is explained in greater detail by way of examples illustrated in the drawing showing in FIG. 1*a*, b perspectively, a crank loop frame as well as a cross-section of a crank loop frame web;

FIG. 2 a perspective, exploded view of the crank loop frame according to FIG. 1;

FIG. 3*a*, b a side view of a crank loop frame partly sectioned as well as a transverse section along line IIIb—IIIb in FIG. 3*a*;

FIG. 4 perspectively, another embodiment of the crank loop frame;

FIG. 5 perspectively, a longitudinal section of the crank loop frame according to FIG. 4;

FIG. 6*a* perspectively, a longitudinal section of the crank loop frame with pittings in the slideways;

FIG. 6*b* a cutout of a slideway area in longitudinal section;

FIG. 7 perspectively, slideway plates.

A crank loop frame 1 according to the invention, such as for a piston type internal combustion engine with crank loop drive, usually has two mutually opposite slideway frame webs 2, 3 and two face webs 4, 5 so that an interior space 6 is formed.

In the longitudinal center of the slideway frame webs 2, 3 are disposed, perpendicular to them, the outsides of the piston rods 7 of two mutually opposite, not shown piston/cylinder units of the internal combustion engine. The not shown slide of the crank loop drive sits in the interior space 6 of the crank loop frame 1 in a manner known per se.

It is essential that the slideway frame webs 2, 3 are of H-shaped cross-section (FIG. 1*b*) and contain the horizontal slideway web 8 and the two vertical leg webs 9 attached to the longitudinal edges of the slideway web 8. The slidway web 8 is disposed centrally between the leg webs 9, i.e. the height of the leg webs 9 above and below the slideway web 8 is the same. However ever, if the heat flow and/or the heat capacity and/or the heat distribution so require, this symmetry may be varied.

The slidway web 8 form the mutually opposite, plane slideways 10 inside the frame for the slide.

The crank loop frame 1 shown is of two-part design, being centrally divided lengthwise, there being provided at each end of the slideway frame webs 2, 3 a face web half 11, and the faces 12 of the face web halves 11 being joined together in the parting plane.

The slideway frame webs 2, 3 may be joined together by welding, preferably electron beam welding (FIG. 4). But it is also possible to produce the crank loop frame 1 as a single part.

However, it is purposeful to design the crank loop frame 1 as a two-part unit. An assembly advantageous for the purposes of the invention is shown in FIGS. 1 and 2. It is accomplished by means of two rectangular, metallic clamping strap rings 13. For mounting the clamping strap rings 13 there is disposed at the face of each face web half 11 a U-shaped, as viewed from the front, clamping strap mounting web 15 having plane outer surfaces 14 and extending in longitudinal direction of the slideway frame webs 2, 3. In the assembled state of the slideway frame webs 2, 3, the clamping strap mounting webs 15 form a clamping strap frame with plane outside surfaces on which the clamping strap is seated with press fit.

To prevent shifting of the slideway frame webs 2, 3 in the parting plane, spacer bolts 16 are provided between the U-legs of neighboring clamping strap mounting webs 15 in the parting plane, said spacer bolts 16 having at their ends a supporting disc 17 each and, expendiently, adjacent thereto on the outside, a bearing disc 18 of smaller diameter. Semicircular recesses 19 are machined into the free end edges 20 of the clamping strap mounting webs 15 to accommodate the bearing discs 18. In the assembled state of the crank loop frame 1 (FIG. 1), the supporting discs 17 are supported by the inside surface of the clamping strap mounting webs 15 while the bearing discs 18 are seated in form-closing fashion in the recesses 19 and outwardly covered by the clamping strap ring 13. This clamping strap assembly makes possible a simple and quick assembly of the individual components of the crank loop frame 1 and an expansion of the crank loop frame 1 in the direction axis-parallel to the piston rods 7.

In the interior space 6 of the crank loop frame 1 according to the invention sits the slide as in a cage because the leg webs 9 directed towards the interior space 6 overlap the slide laterally.

For reasons of production engineering and stability, the transition from the leg webs 9 facing the interior space to the face web halves 11 may be rounded so that an oval hole 20*a* is formed.

The face ends of the crank loop frame 12 are open, which favors the heat flow and the heat distribution and, in addition, helps the light-weight construction.

The clamping strap 13 which is supposed to absorb the heat expansions and safeguard the bolt safety also assumes the special job, however, of bridging the heat flow impeding gap between the slideway frame webs 2, 3 in the parting plane and of assuring rapid heat conduction and distribution. The bolt 16 also contributes in the same manner to the heat conduction and distribution.

Another advantageous assembly of the slideway frame webs 2, 3 is accomplished by necked-down screws 21 according to the embodiment shown in FIG. 3. Therein, a hole 22 through which the screw shaft of the necked-down screw 21 passes is provided in the end of each slideway web 8, the screw head 22 being supported on the frame outside by the surface of the slideway web 8, and the respective external threaed 23 at the end of two mutually opposite necked-down screws 21 engaging a corresponding internal thread in a cuboid connecting block 24 which bridges the parting plane. Expediently, the connecting block 24 contacts the inside surfaces of the face web halves 11 (FIG. 3*b*), with edges of semicircular recesses 19*a* provided in the face web halves 11 being seated in a ring groove 25 of a pin 26 disposed on the outside of the block 24 so that a mutual shifting of the slideway frame webs 2, 3 in the parting plane is prevented in this embodiment also.

It is advantageous to provide, on the inside surfaces of the leg webs 9 facing the interior, lengthwise extending, raised and plane guiding or supporting webs 27 for the slide so that the slide is guided laterally and lateral heat transfer is possible also, which promotes rapid heat conduction and distribution (FIGS. 4, 5).

FIG. 6*a*/*b* shows that, according to the invention, pittings or depressions 29 are machined into the slide surfaces 10 of the slideways of the slideway web 8 and preferably also into the slide surfaces 28 of the guiding webs 27, said pittings or depressions 29 serving as oil reservoir and preventing the disruption of the lubricant film between the sliding surfaces 10, 28 and the corresponding surfaces of the slide. The shape, number and configuration of the pittings 29 is chosen on the basis of empiric determinations. The pittings or the prevention of the lubricant film disruption exlcude heat peaks, thus favoring rapid heat conduction and distribution.

Shown in FIG. 7 are slide plates 30, U-shaped in cross-section and of a special metal or of ceramic, which can be arranged on the slideways 10 by means of a bearing surface 34. They have within their interior space a slide base surface 31 extending parallel to the slide surfaces 10, as well as support webs 27*a* bent at the rims at right angles to the interior space 6. The support webs 27*a* form either slide surfaces for the slide or they serve as form-closing seat for the slide plates 30 under the support webs 27. The slide plates 30 may be fastened randomly to the slideway frame webs 2, 3. It is expedient to have a shackle 32 clipped around the ends of the slideway webs 8 or bent tabs 33 grip behind the face web halves 11. The slide plates 30 promote in particular the homogeneous heat flow in the frame 1, but they can expediently also serve to impede the heat flow. The slide plates 30 may be zonally of different construction in longitudinal direction so that a targeted influence on the heat flow is effected. But the slide plates 30 may also be of layered construction perpendicular to their longitudinal extent in order to be able to exert a targeted influence on the heat flow in this direction also.

We claim:

1. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slideway frame webs and between face webs on each end thereof and in which slide is rotatably mounted a crank pin of a driven crank performing the rotary motion, the crank pin axis extending transverse to the piston rod axis, characterized in that each of the slideway frame webs of the crank loop frame includes portions of the heat capacity sufficient for a homogeneous distribution of the heat disposed both above and below the slideway of the slideway frame web, each of the slideway frame webs has an H-shaped cross-section and contains a longitudinal slideway web portion as well as two leg web portions disposed tangentially at the longitudinal edges of the slideway web portion, the areal center of gravity of each slideway frame web being disposed to the side of its respective slideway remote from the slide, thereby to promote dissipation or the homogeneous distribution of heat to both sides of the slideways.

2. Crank loop frame according to claim 1, characterized in that the H legs adjacent the slide are designed higher than the H legs adjacent the piston rod.

3. Crank loop frame according to claim 1, characterized in that the H legs adjacent the piston rod are designed higher than the H legs adjacent the slide.

4. Crank loop frame according to claim 1 characterized in that the leg web portions are designed higher adjacent the piston rod than adjacent the face webs of the crank loop frame.

5. Crank loop frame according to claim 1 characterized in that additional masses with additional heat capacity are provided in the area of the face webs.

6. Crank loop frame according to claim 1, characterized in that a poorly heat conducting coating is applied to the surface of the slideways of the slideway frame webs facing the slide.

7. Crank loop frame according to claim 6, characterized in that the coating consists of ceramic.

8. Crank loop frame according to claim 1, characterized in that a plate of poorly heat conducting material is disposed on the surface of the slideways of the slideway frame webs facing the slide.

9. Crank loop frame according to claim 8, characterized in that the plate consists of ceramic.

10. Crank loop frame according to claim 1 characterized in that a coating or plate of poorly heat conducting material is disposed on the surface of the slideways of the slideway frame webs facing the slide and is constructed of layers of ceramic foils of different heat conductivity and/or heat capacity.

11. Crank loop frame according to claim 1 characterized in that the crank loop frame is of two-part design, being divided centrally longitudinally, there being provided at the ends of each of the slideway frame webs a face web half each, and surfaces of the face web halves being placed against each other in the parting plane.

12. Crank loop frame according to claim 11, characterized in that the slideway frame webs are joined together by welding, preferably electron beam welding.

13. Crank loop frame according to claim 1, characterized in that the longitudinal slideway web portion extends horizontally and the leg web portions extend vertically.

14. Crank loop frame according to claim 1, characterized in that pittings are provided in the surfaces of the slideway frame webs facing the slide.

15. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slide frame webs and in which slide is rotatably mounted a crank pin of a driven crank performing the rotary motion, the crank pin axis extending transverse to the piston rod axis, characterized in that each of the slideway frame webs of the crank loop frame includes portions of a heat capacity sufficient for a homogeneous distribution of the heat disposed both above and below the slideway of the slide frame web, and a coating or plate of poorly heat conducting material is disposed on the surface of the slideways of the slideway frame webs facing the slide and has zonally different heat conducting capabilities in the longitudinal extent of the slideways.

16. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slide frame webs and in which slide is rotatably mounted a crank pin of a driven crank performing the rotary motion, the crank pin axis extending transverse to the piston rod axis, characterized in that each of the slideway frame webs of the crank loop frame includes portions of a heat capacity sufficient for a homogeneous distribution of the heat disposed both above and below the slideway of the slide frame web and a coating or plate of poorly heat conducting material is disposed on the surface of the slideways of the slideway frame webs facing the slide and has zonally different heat conducting capabilities transverse to the longitudinal extent of the slideways.

17. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slide frame webs and in which slide is rotatably mounted a crank pin of a driven crank performing the rotary motion, the crank pin axis extending transverse to the piston rod axis, characterized in that each of the slideway frame webs of the crank loop frame includes portions of a heat capacity sufficient for a homogeneous distribution of the heat disposed both above and below the slideway of the slide frame web;

the crank loop frame is of two-part design, being divided centrally longitudinally, there being provided at the ends of each of the slideway frame webs a face web half each, and surfaces of the face web halves being placed against each other in the parting plane; and the slideway frame webs are held together at the face web halves by means of a clamping strap ring at each end.

18. Crank loop frame according to claim 17, characterized in that a U-shaped clamping strap mounting web having plane outside surfaces and extending in the longitudinal direction of the slideway frame webs is provided at the face of each face web half for the mounting of the clamping strap rings.

19. Crank loop frame according to claim 18, characterized in that spacer bolts are disposed between the U legs of neighboring clamping strap mounting webs in the parting plane, said spacer bolts having at their ends a supporting disc each and adjacent thereto on the outside, a seating disc each of smaller diameter, semicircular recesses being machined into the free end edges of the clamping strap webs for the seating discs, and the supporting discs supporting themselves against the inside surface of the clamping strap mounting webs while the seating discs are seated in form-closing fashion in the recesses and their outsides are covered by the clamping strap.

20. Crank loop frame according to claim 18, characterized in that the slideway frame webs are joined together at the faces by means of necked-down screws.

21. Crank loop frame according to claim 20, characterized in that there is provided in each slideway frame web a hole which is penetrated by the screw shaft of the necked-down screw, the screw head supporting itself on the outside of the frame against the slideway frame web surface and the respective external threads at the ends of two necked-down screws disposed opposite each other engaging corresponding internal threads in a cuboid connecting block which bridges the parting plane.

22. Crank loop frame according to claim 21, characterized in that the connecting block is in contact with the inside surfaces of the face web halves, with edges of semicircular recesses provided in the face web halves seated in a ring groove of a pin provided on the block.

23. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slide frame webs and in which slide is rotatably mounted a crank pin of a driven crank performing the rotary motion, the crank pin axis extending transverse to the piston rod axis, characterized in that each of the slideway frame webs of the crank loop frame includes portions of a heat capacity sufficient for a homogeneous distribution of the heat disposed both above and below the slideway of the slide frame web, and raised, plane guide webs extending in the longitudinal direction are provided for the slide on the inside surface of leg web portions facing the interior space.

24. Crank loop frame according to claim 23 characterized in that pittings are provided in the surfaces of the guide webs facing the slide.

25. Crank loop frame for a crank loop drive of an internal combustion engine for the transformation of a back and forth motion into a rotary motion, the internal combustion engine having at least two piston/cylinder units opposite each other on one axis, their piston rods, rigidly attached to the piston, being coupled by the crank loop drive which is disposed between the piston/-cylinder units and consists of the crank loop frame to whose slideway frame webs the piston rods are also rigidly attached and in whose interior space sits a slide which is guided by longitudinally extending slideways disposed intermediate the slide frame webs and in which slide is rotatably mounted a crank pin of a driven crank performing the rotary motion, the crank pin axis extending transverse to the piston rod axis, characterized in that each of the slideway frame webs of the crank loop frame includes portions of a heat capacity sufficient for a homogeneous distribution of the heat disposed both above and below the slideway of the slide frame web and plates of poorly heat conducting material are disposed on the surface of the slideways of the slide frame webs facing the slide, the plates being of U-shaped design in cross section and seated on the slideways by means of a bearing surface and the plates having in their interior a slide base surface extending parallel to the slide surfaces, as well as supporting webs bent at right angles towards the slide at the rim.

26. Crank loop frame according to claim 25, characterized in that the slide plates have at their ends hoops to clamp around the slideway frame webs.

27. Crank loop frame according to claim 25, characterized in that the slide plates have bent up tabs to grip the face webs.

* * * * *